US010393143B2

(12) United States Patent
Kuno et al.

(10) Patent No.: US 10,393,143 B2
(45) Date of Patent: Aug. 27, 2019

(54) COMPRESSOR WITH ANNULAR DIFFUSER HAVING FIRST VANES AND SECOND VANES

(71) Applicant: HONDA MOTOR CO., LTD., Tokyo (JP)

(72) Inventors: Naoki Kuno, Wako (JP); Naoki Itoh, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 233 days.

(21) Appl. No.: 15/490,900

(22) Filed: Apr. 19, 2017

(65) Prior Publication Data

US 2017/0298942 A1 Oct. 19, 2017

(30) Foreign Application Priority Data

Apr. 19, 2016 (JP) ..... 2016-083765

(51) Int. Cl.
*F04D 29/44* (2006.01)
*F04D 29/28* (2006.01)

(52) U.S. Cl.
CPC ..... *F04D 29/444* (2013.01); *F04D 29/284* (2013.01); *F05D 2220/40* (2013.01)

(58) Field of Classification Search
CPC .... F04D 17/10; F04D 29/444; F05D 2220/40; F05B 2220/40
USPC ..... 415/208.3, 208.4, 211.1
See application file for complete search history.

(56) References Cited

U.S. PATENT DOCUMENTS 4,824,325 A 4/1989 Bandukwalla
6,607,353 B2 * 8/2003 Masutani ..... F04D 29/462 415/161

FOREIGN PATENT DOCUMENTS

CN 101586581 11/2009
JP 2001-214896 8/2001
WO WO2016/160393 * 10/2016 ..... F04D 29/444

OTHER PUBLICATIONS

Chinese Office Action for corresponding CN Application No. 201710247320.0, dated Sep. 5, 2018.

* cited by examiner

*Primary Examiner* — Christopher Verdier
(74) *Attorney, Agent, or Firm* — Mori & Ward, LLP

(57) ABSTRACT

A compressor includes an impeller having a rotational axis. An annular diffuser is provided around the rotational axis to surround the impeller in order to decelerate the fluid discharged from the impeller in a centrifugal direction with respect to the rotational axis. The annular diffuser includes first vanes and second vanes. The first vanes are arranged in a first blade row extending in a circumferential direction around the rotational axis such that two adjacent vanes among the first vanes do not define a throat therebetween viewed along the rotational axis. The second vanes are arranged in a second blade row which extends in the circumferential direction and which is provided farther than the first blade row in the centrifugal direction from the rotational axis. A number of the second vanes is two times or more as large as a number of first vanes.

6 Claims, 5 Drawing Sheets

COMPRESSOR WITH ANNULAR DIFFUSER HAVING FIRST VANES AND SECOND VANES

CROSS-REFERENCE TO RELATED APPLICATIONS

The present application claims priority under 35 U.S.C. § 119 to Japanese Patent Application No. 2016-083765, filed Apr. 19, 2016, entitled "Compressor." The contents of this application are incorporated herein by reference in their entirety.

BACKGROUND

1. Field

The present disclosure relates to a compressor.

2. Description of the Related Art

A turbocharger includes a compressor housing, forming part of an intake gas flow path of an internal combustion engine, and a compressor impeller, rotatably disposed inside the compressor housing. The compressor impeller is connected to a turbine impeller with a rotation shaft interposed therebetween, the turbine impeller being rotatably disposed in a turbine housing, forming part of the exhaust gas flow path of the internal combustion engine. When the turbine impeller rotates in response to a flow of exhaust gas, the compressor impeller also rotates. Thus, intake gas is ejected toward an annular scroll flow path disposed around the compressor impeller, whereby the pressure of the intake gas is raised.

To further raise the static pressure, a disk-shaped diffuser is disposed so as to surround the compressor impeller between the impeller chamber, which houses the compressor impeller, and the scroll flow path (see, for example, Japanese Patent Application Publication No. 2001-214896). The diffuser has blade rows extending in the circumferential direction. The intake gas ejected from the compressor impeller in the centrifugal direction is decelerated by the blade rows of the diffuser, so that the pressure of the intake gas is raised. Japanese Patent Application Publication No. 2001-214896 discloses a technology of a diffuser including two blade rows on the inner and outer sides in the centrifugal direction to further improve the static pressure rise efficiency of the diffuser.

SUMMARY

According to one aspect of the present invention, a compressor that compresses a fluid flowing through a fluid flow path includes an impeller rotatably disposed inside the fluid flow path, and an annular diffuser disposed around the impeller, the diffuser decelerating the fluid ejected from the impeller in a centrifugal direction. The diffuser includes a first blade row, extending in the circumferential direction, and a second blade row, extending in the circumferential direction and located further in the centrifugal direction than is the first blade row. The number of second vanes included in the second blade row is twice the number of first vanes included in the first blade row or larger. Each first vane and an adjacent first vane do not define a throat therebetween.

According to another aspect of the present invention, a compressor includes a fluid flow path, an impeller, and an annular diffuser. Fluid is to flow through the fluid flow path. The impeller is provided in the fluid flow path and has a rotational axis around which the impeller is rotatable. The annular diffuser is provided around the rotational axis to surround the impeller in order to decelerate the fluid discharged from the impeller in a centrifugal direction with respect to the rotational axis. The annular diffuser includes first vanes and second vanes. The first vanes are arranged in a first blade row extending in a circumferential direction around the rotational axis such that two adjacent vanes among the first vanes do not define a throat therebetween viewed along the rotational axis. The second vanes are arranged in a second blade row which extends in the circumferential direction and which is provided farther than the first blade row in the centrifugal direction from the rotational axis. A number of the second vanes is two times or more as large as a number of first vanes.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
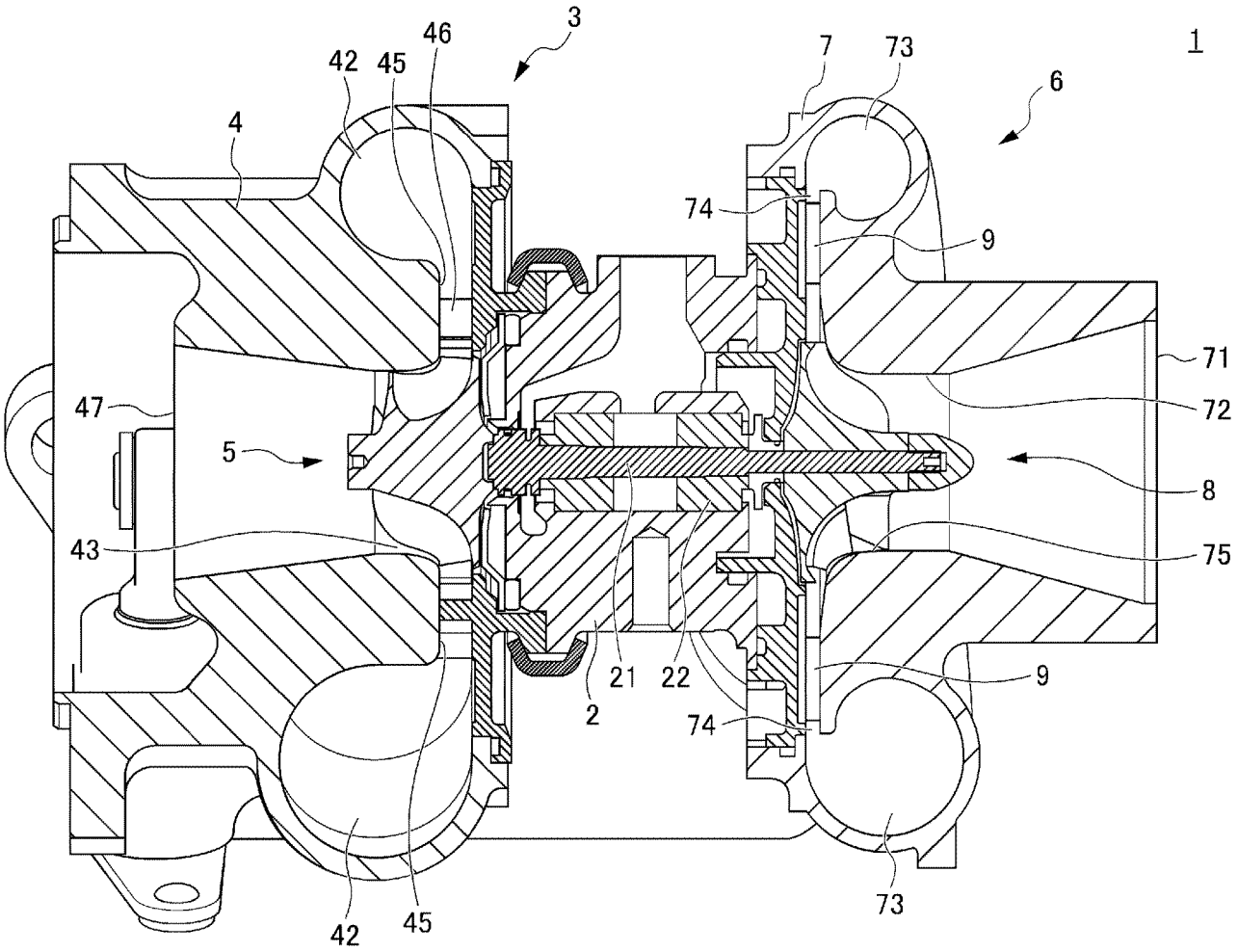
FIG. 1 is a sectional configuration view of a turbocharger including a compressor according to an embodiment of the present disclosure.

The embodiments will now be described with reference to the accompanying drawings, wherein like reference numerals designate corresponding or identical elements throughout the various drawings.

Referring now to the drawings, an embodiment of the present disclosure is described below.

FIG. 1 is a sectional configuration view of a turbocharger 1 including a compressor according to an embodiment.

The turbocharger 1 includes a bearing housing 2, a turbine 3, mounted on one end portion of the bearing housing 2, and a compressor 6, mounted on the other end portion of the bearing housing 2. The bearing housing 2 includes a stick-shaped rotation shaft 21, extending between the turbine 3 and the compressor 6, and a bearing 22, which supports the rotation shaft 21 such that the rotation shaft 21 is rotatable.

The turbine 3 includes a turbine housing 4, forming part of the exhaust gas flow path of an internal combustion engine, not illustrated, and a turbine impeller 5, disposed inside the turbine housing 4.

The turbine housing 4 includes a tube-shaped exhaust gas intake portion, not illustrated, connected to an exhaust gas pipe of the internal combustion engine, an annular scroll flow path 42, through which exhaust gas sucked from the exhaust gas intake portion flows, a tube-shaped turbine impeller chamber 43 disposed so as to be surrounded by the scroll flow path 42, and an annular exhaust gas flow path 45, which connects the scroll flow path 42 and a base end portion of the turbine impeller chamber 43 to each other.

The turbine impeller 5 is rotatably disposed inside the turbine impeller chamber 43 while being coupled to one end portion of the rotation shaft 21. Multiple blade-shaped nozzle vanes 46 are disposed in the exhaust gas flow path 45 equidistantly in the circumferential direction of the rotation shaft 21 and at a predetermined angle with respect to the circumferential direction so as to surround the base end portion of the turbine impeller chamber 43.

The compressor 6 includes a compressor housing 7, which forms part of the intake gas flow path of an internal combustion engine, and a compressor impeller 8 and a diffuser 9, which are disposed inside the compressor housing 7.

The compressor housing 7 includes a tube-shaped compressor impeller chamber 72, an annular scroll flow path 73, disposed so as to surround the compressor impeller chamber 72, and an annular intake gas flow path 74, which connects a base end portion of the compressor impeller chamber 72 and the scroll flow path 73 to each other. The compressor impeller chamber 72 includes an intake gas intake portion 71 at a far end portion and a shroud 75 at a base end portion, the intake gas intake portion 71 being connected to an intake gas pipe (not illustrated) of an internal combustion engine.

The compressor impeller 8 is rotatably disposed inside the shroud 75 while being coupled to another end portion of the rotation shaft 21. The diffuser 9 has a disk shape and is disposed in the intake gas flow path 74. The diffuser 9 compresses intake gas ejected from the base end portion of the shroud 75 toward the scroll flow path 73 in the centrifugal direction of the rotation shaft 21 by decelerating the intake gas. The detailed configuration of the compressor impeller 8 and the diffuser 9 is described below with reference to FIG. 2 to FIG. 5B.

The turbocharger 1 having the above-described configuration supercharges the intake gas using the energy of the exhaust gas of the internal combustion engine in the following procedure.

Firstly, the exhaust gas of the internal combustion engine is introduced into the scroll flow path 42 through an exhaust gas intake portion (not illustrated). The exhaust gas provided with a rotation as a result of passing through the scroll flow path 42 flows into a base end portion of the turbine impeller chamber 43 at an angle defined by the nozzle vanes 46, rotates the turbine impeller 5, and is ejected from an ejection portion 47 at a far end portion of the turbine impeller chamber 43. The rotation of the turbine impeller 5 is transmitted to the compressor impeller 8 by the rotation shaft 21, so that the compressor impeller 8 is rotated inside the compressor impeller chamber 72. The rotation of the compressor impeller 8 causes the intake gas introduced into the compressor impeller chamber 72 through the intake gas intake portion 71 to be ejected from the base end portion of the compressor impeller 8 toward the scroll flow path 73 in the centrifugal direction. The intake gas ejected from the compressor impeller 8 is decelerated while being diffused by the diffuser 9, so that the intake gas is compressed. The compressed intake gas flows through the scroll flow path 73 and is introduced into an intake gas port of an internal combustion engine, not illustrated.

Figure 2:
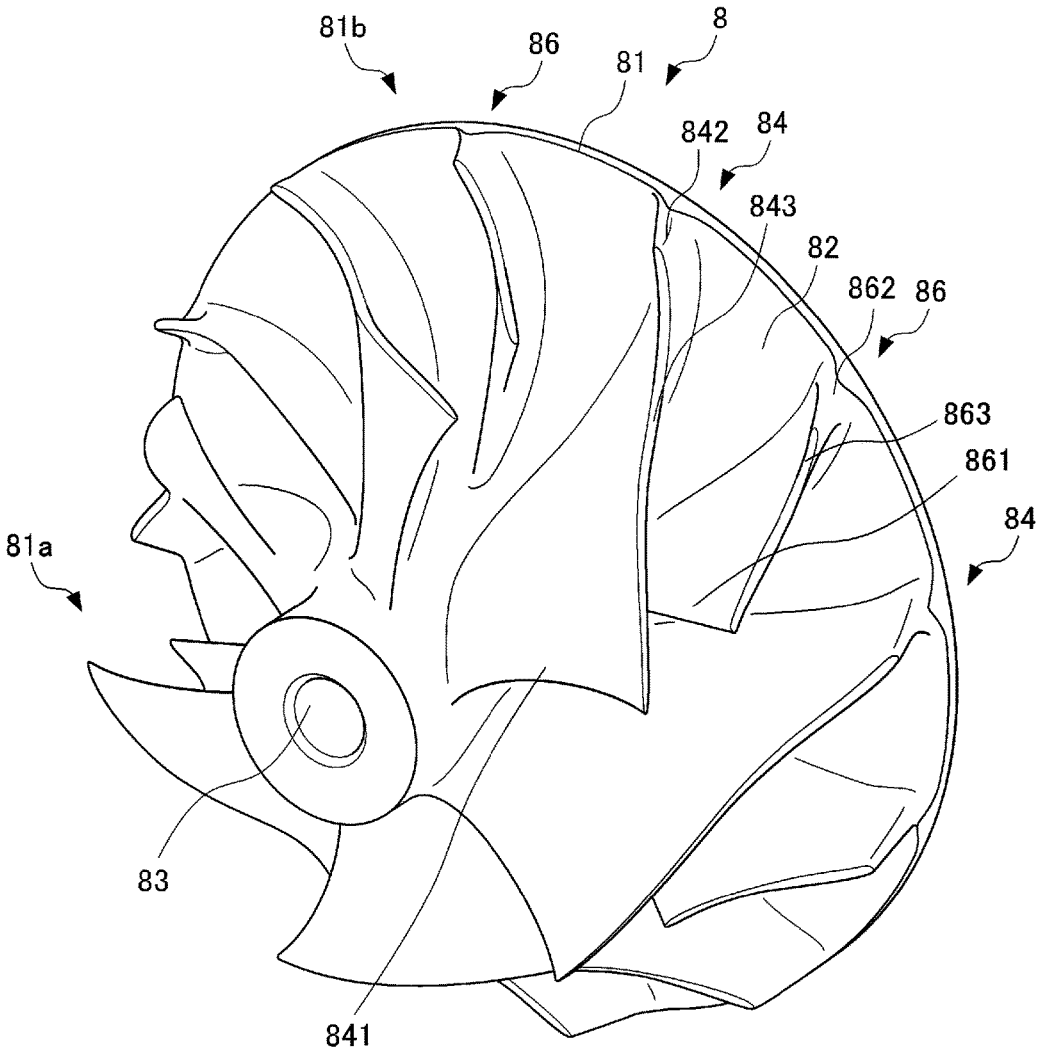
FIG. 2 is a perspective view of a compressor impeller.

FIG. 2 is a perspective view of the compressor impeller 8.

The compressor impeller 8 includes a conical wheel 81 and multiple main blades 84 and multiple splitters 86, which have plate shapes and are disposed on the outer surface of the wheel 81.

The wheel 81 has a hub surface 82 and a shaft receiving hole 83. The hub surface 82 smoothly extends outward in the centrifugal direction from a far end portion 81*a* to a base end portion 81*b* in the axial direction. The shaft receiving hole 83 passes through the wheel 81 from the base end portion 81*b* to the far end portion 81*a* at the center portion of the hub surface 82. The rotation shaft 21 coupled with the turbine impeller 5 is connected to the wheel 81 with a cap, not illustrated, being screwed thereon while being inserted into the shaft receiving hole 83. Thus, the compressor impeller 8 and the turbine impeller 5 are integrated with each other using the rotation shaft 21.

The multiple main blades 84 are disposed on the hub surface 82 of the wheel 81 equidistantly in the circumferential direction. The main blades 84 are disposed on the hub surface 82 at predetermined angle intervals. Each main blade 84 has a plate shape extending from a front edge portion 841 at the far end portion 81*a*, which is an inlet portion of the intake gas, toward a rear edge portion 842 at the base end portion 81*b*, which is an outlet portion of the intake gas. Each main blade 84 has a tip edge 843 having a shape that follows the shape of the surface of the shroud 75 (see FIG. 1) that the tip edge 843 faces when the compressor impeller 8 is housed in the compressor impeller chamber 72.

Each splitter 86 is disposed between each pair of adjacent main blades 84 on the hub surface 82. The splitters 86 are disposed on the hub surface 82 at predetermined angle intervals. Each splitter 86 has a plate shape extending from a front edge portion 861 at the far end portion 81*a* toward a rear edge portion 862 at the base end portion 81*b*. Each splitter 86 has a tip edge 863 having a shape that follows the shape of the surface of the shroud 75 (see FIG. 1), as in the case of the tip edge 843 of each main blade 84. The length of each splitter 86 from the front edge portion 861 to the rear edge portion 862 is shorter than the length of each main blade 84 from the front edge portion 841 to the rear edge portion 842. The front edge portion 861 of each splitter 86 is located closer to the base end portion 81*b* than is the front edge portion 841 of each main blade 84. The rear edge portion 862 of each splitter 86 is disposed so as to be flush with the rear edge portion 842 of each main blade 84.

The compressor impeller 8 having the above-described configuration rotates clockwise in FIG. 2 when the turbine impeller 5, coupled to the compressor impeller 8 using the rotation shaft 21, is rotated by being blown by exhaust gas. When the compressor impeller 8 rotates in the compressor impeller chamber 72, the intake gas flowing into the compressor impeller chamber 72 from the far end portion 81*a* flows in the axial direction from the front edge portion 841 of each main blade 84 and the front edge portion 861 of each splitter 86, passes between each main blade 84 and the corresponding splitter 86, and is ejected outward in the centrifugal direction from the rear edge portions 842 and 862.

Figure 3:
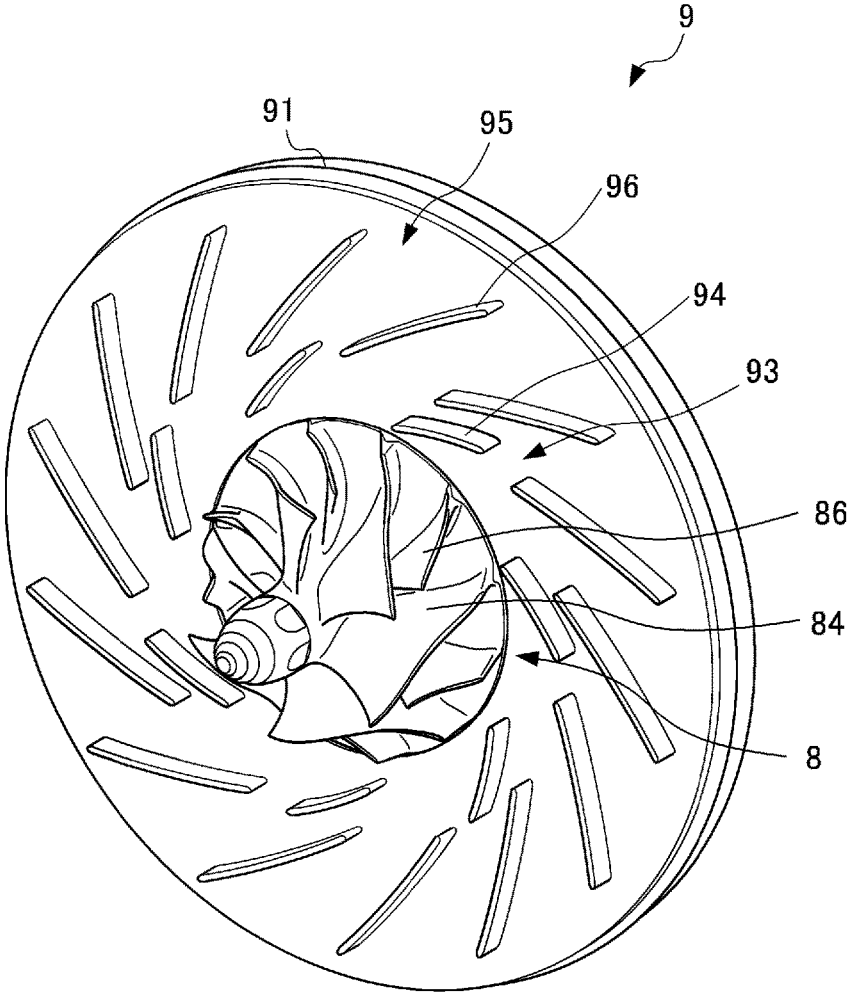
FIG. 3 is a perspective view of the compressor impeller and a diffuser.
Figure 4:
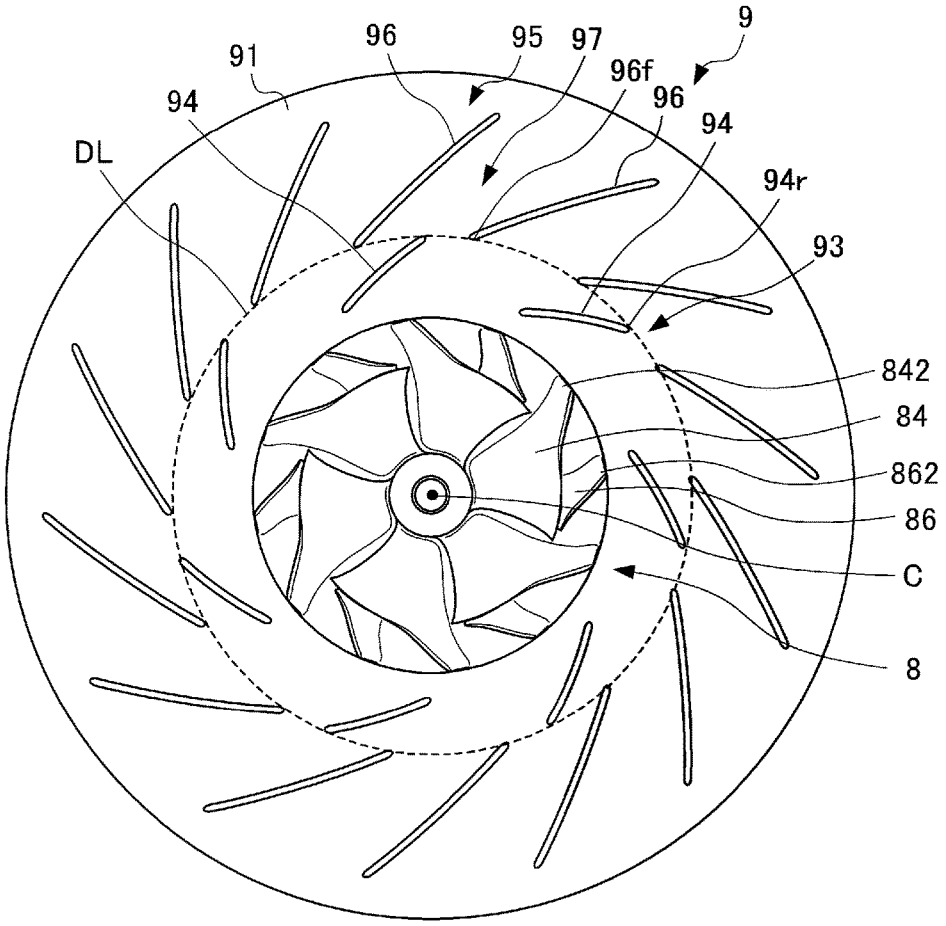
FIG. 4 is a plan view of the compressor impeller and the diffuser.

FIG. 3 is a perspective view of the compressor impeller 8 and the diffuser 9 and FIG. 4 is a plan view of the compressor impeller 8 and the diffuser 9. Although the compressor impeller 8 and the diffuser 9 are separate components, they are collectively illustrated in FIG. 3 and FIG. 4 in the state of being housed in the compressor housing 7 for purposes of illustration convenience.

The diffuser 9 has a disk shape having an outer diameter larger than the outer diameter of the compressor impeller 8. The diffuser 9 is fixed into the annular intake gas flow path 74 (see FIG. 1) of the compressor housing 7 so as to surround the base end portion of the compressor impeller 8. The diffuser 9 includes a disk 91 and a first blade row 93 and a second blade row 95, which are disposed on the surface of the disk 91.

The first blade row 93 includes multiple (seven, in the example illustrated in FIG. 4) streak-like first vanes 94 that stand erect on the surface of the disk 91 equidistantly in the circumferential direction around the center line C of the rotation shaft 21. Each first vane 94 is substantially linear and extends from the inside to the outside at a predetermined angle with respect to the centrifugal direction. The height of each first vane 94 is substantially equal to the height of the rear edge portions 842 and 862 of the compressor impeller 8. A throat that restricts the flow rate of the intake gas ejected from the rear edge portions 842 and 862 of the compressor impeller 8 is not defined between each pair of adjacent first vanes 94. The definition of a throat in the present disclosure is described below in detail with reference to FIGS. 5A and 5B.

The second blade row 95 includes multiple streak-like second vanes 96 that stand erect on the surface of the disk 91 equidistantly in the circumferential direction at a position located further in the centrifugal direction than is the first blade row 93. The number of the second vanes 96 included in the second blade row 95 is preferably twice the number of the first vanes 94 included in the first blade row 93 or larger. FIG. 3 and FIG. 4 illustrate the case where the number of the second vanes 96 is 14, which is twice the number of the first vanes 94.

Each second vane 96 is substantially linear and extends from the inside to the outside at a predetermined angle with respect to the centrifugal direction. A choke length of each second vane 96 is longer than a choke length of each first vane 94. As illustrated with a broken line DL in FIG. 4, the distance from the center line C to a front end portion 96*f* of each second vane 96, located on the inner side in the centrifugal direction, is substantially equal to the distance from the center line C to a rear end portion 94*r* of each first vane 94, located on the outer side in the centrifugal direction. The height of each second vane 96 is substantially equal to the height of each first vane 94. Throats 97, which restrict the flow rate of the intake gas ejected from the first blade row 93, are defined by each pair of adjacent second vanes 96.

The function of the diffuser 9 having the above-described configuration is described. When the compressor impeller 8 rotates clockwise in FIG. 4 around the center line C, intake gas is taken into the compressor impeller 8 in the axial direction and then ejected from the rear edge portions 842 and 862 of the compressor impeller 8 toward the outer side in the centrifugal direction over the surface of the diffuser 9. The intake gas ejected from the compressor impeller 8 is diffused to the outer side in the centrifugal direction while being decelerated by the first blade row 93 having no throat and then further decelerated by the second blade row 95 having the throats 97. Thus, the pressure of the intake gas is raised.

Figure 5A:
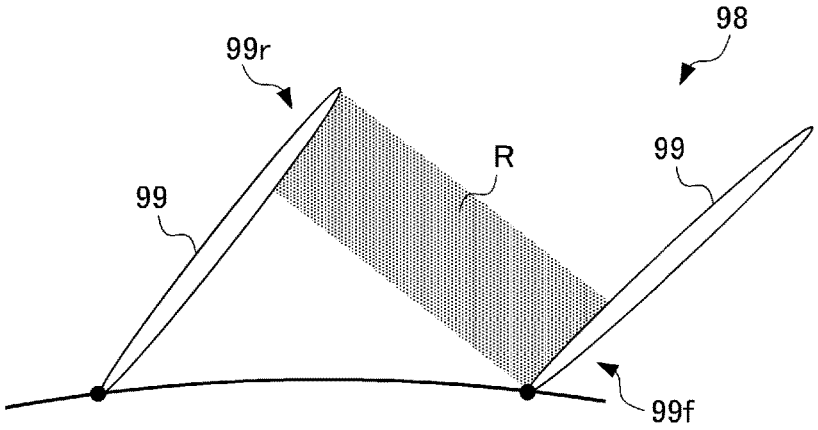
FIG. 5A illustrates an example of a blade row that has vanes defining a throat therebetween.
Figure 5B:
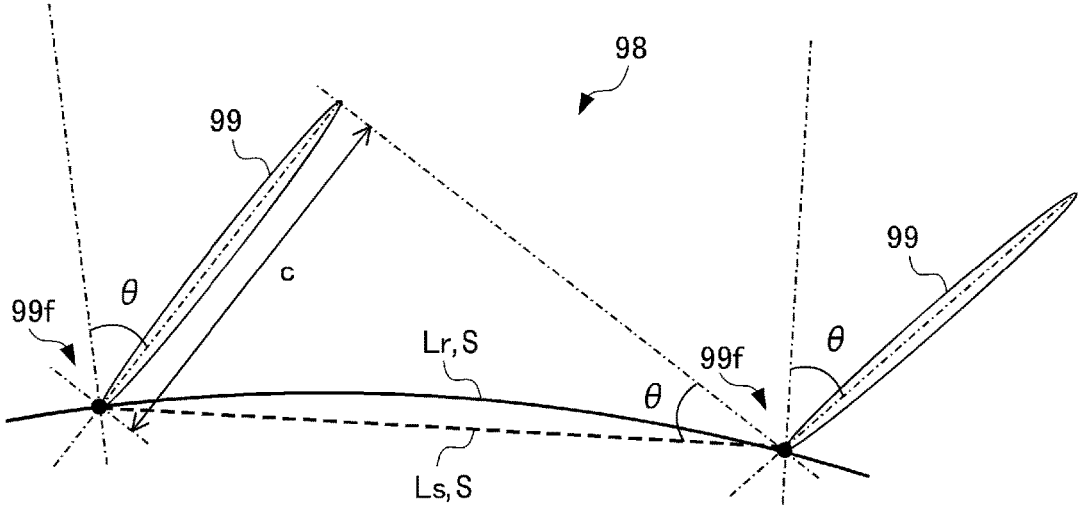
FIG. 5B illustrates a geometrical definition of the throat.

Referring now to FIGS. 5A and 5B, the definition of a throat in the present disclosure is described.

FIG. 5A illustrates an example of a blade row 98 having a throat between a pair of vanes 99. As illustrated in FIG. 5A, whether a throat according to the present disclosure is defined is determined on the basis of whether each pair of adjacent vanes 99 define a region R in which a front end portion 99*f* of one of the vanes 99 faces a rear end portion 99*r* of the other vane 99. For example, if the first blade row 93 (see FIG. 4) of the diffuser 9 according to this embodiment, located on the inner side in the centrifugal direction, has the region R as illustrated in FIG. 5A, the first blade row 93 may cause a choke, in which a shock wave occurs and the flow is choked, in the region R. The first blade row 93 according to this embodiment is thus disposed so as not to include a throat as illustrated in FIG. 5A to reliably provide a wide flow rate range.

FIG. 5B illustrates the geometrical definition of a throat. The choke length of each vane 99 is denoted with "c", the angle formed by each vane 99 and the centrifugal direction is denoted with "0", and the distance between the front end portion 99*f* of each vane 99, located on the inner side in the centrifugal direction, and the front end portion 99*f* of an adjacent vane 99 is denoted with "S". In this case, whether a throat is provided, that is, whether the region R illustrated in FIG. 5A is disposed can be paraphrased by whether inequality 3 below is satisfied. Here, the distance S may be a length extending so as to follow an arc Lr between the front end portions 99*f* or a length extending along a straight line Ls between the front end portions 99*f*:

$$c \leq S \cdot \sin\theta, \qquad \text{inequality 3.}$$

When c in inequality 3 satisfies the equation, that is, when $c = S \cdot \sin\theta$, it can be said that the blade row 98 has no geometrically defined throat. This condition, however, is insufficient for preventing a choke, so that a choke may occur on the side on which the flow rate is higher. Thus, preferably, in the first blade row 93 according to this embodiment, the choke length of each first vane 94, the angle formed between each first vane 94 and the centrifugal direction, and the distance between each pair of adjacent first vanes 94 are determined so as to satisfy inequality 4, below, in which a margin constant M larger than zero is added to inequality 3. Also preferably, the margin constant M is approximately 10% of the choke length of each first vane 94 (that is, $M = c/10$) to have a sufficient effect of preventing a choke:

$$c \leq S \cdot \sin\theta - M, \qquad \text{inequality 4.}$$

The compressor 6 according to this embodiment has the following effects.

(1) In this embodiment, the compressor 6 can have high static pressure rise efficiency since the diffuser 9 has the first blade row 93 and the second blade row 95 respectively disposed on the inner side and the outer side in the centrifugal direction. In addition, in this embodiment, the number of the second vanes 96 included in the second blade row 95, located on the outer side, is twice the number of the first vanes 94 included in the first blade row 93, located on the inner side. In addition, each first vane 94, located on the inner side, and an adjacent first vane 94 are disposed so as not to define a throat therebetween. This configuration appropriately distributes the load born by the vanes between the second blade row 95, located on the outer side, and the first blade row 93, located on the inner side. Thus, the compressor 6 can have high static pressure rise efficiency while the flow rate range is expanded.

(2) In this embodiment, the choke length of each first vane 94, denoted with "c", the angle formed by each first vane 94 and the centrifugal direction, denoted with "0", the distance between each pair of adjacent first vanes 94, denoted with "S", and the margin constant larger than or equal to zero, denoted with "M", are determined so as to satisfy inequality 4. In other words, the first blade row 93 is disposed so as not to include a geometrically defined throat. Thus, a choke is less likely to be caused in the first blade row 93, so that the flow rate range can be widened further.

(3) In this embodiment, the margin constant M is fixed at approximately 10% of the choke length c of each first vane 94 in inequality 4. This configuration renders a choke further less likely to occur in the first blade row 93, so that the flow rate range can be widened further.

Although an embodiment of the present disclosure has been described thus far, the present disclosure is not limited to this embodiment. Detailed configurations may be appropriately changed within the scope of the present disclosure.

For example, the above-described embodiment includes two blade rows, but the number of blade rows is not limited to two. The number of blade rows may be three or larger.

In the above-described embodiment, a compressor in the present disclosure is included in a turbocharger that compresses intake gas sucked by the internal combustion engine. The present disclosure is not limited to this compressor. Besides a turbocharger of an internal combustion engine, a compressor in the present disclosure may be included in a so-called turbo machine that converts fluid energy to mechanical energy using an impeller, such as a jet engine or a pump.

(1) In an aspect of the present disclosure, a compressor (for example, a compressor 6, described below) that compresses a fluid (for example, intake gas, described below) flowing through a fluid flow path (for example, a compressor impeller chamber 72, described below) includes an impeller (for example, an compressor impeller 8, described below) rotatably disposed inside the fluid flow path, and an annular diffuser (for example, a diffuser 9, described below) disposed around the impeller, the diffuser decelerating the fluid ejected from the impeller in a centrifugal direction. The diffuser includes a first blade row (for example, a first blade row 93, described below), extending in the circumferential direction, and a second blade row (for example, a second blade row 95, described below), extending in the circumferential direction and located further in the centrifugal direction than is the first blade row. The number of second vanes (for example, second vanes 96, described below) included in the second blade row is twice the number of first vanes (for example, first vanes 94, described below) included in the first blade row or larger. Each first vane and an adjacent first vane do not define a throat therebetween.

(2) In the compressor, a choke length of each first vane, denoted with "c", an angle formed by each first vane and the centrifugal direction, denoted with "θ", and a distance between an inner end portion of each first vane in the centrifugal direction and an inner end portion of an adjacent first vane, denoted with "S", preferably satisfy $c \leq S \cdot \sin\theta - M$, mathematical expression 1, where "M" in mathematical expression 1 denotes a positive margin constant.

(3) In the compressor, the margin constant M and the choke length c preferably satisfy $M=c/10$, mathematical expression 2.

(1) In an aspect of the present disclosure, the diffuser includes a first blade row and a second blade row respectively disposed on the inner side and the outer side in the centrifugal direction. Thus, the compressor can have higher static pressure rise efficiency. In an aspect of the present disclosure, the number of second vanes included in the second blade row, located on the outer side, is twice the number of first vanes included in the first blade row, located on the inner side, or larger. Moreover, each first vane, located on the inner side, and an adjacent first vane are disposed so as not to define a throat. This configuration appropriately distributes the load born on the vanes between the second blade row, located on the outer side, and the first blade row, located on the inner side. Thus, the compressor can have higher static pressure rise efficiency while the flow rate range is expanded.

(2) In the present disclosure, the choke length c of each first vane, the angle θ formed between each first vane and the centrifugal direction, the distance S between each pair of adjacent first vanes, and the predetermined margin constant M larger than or equal to zero are determined so as to satisfy inequality 1. In other words, the first blade row is disposed so as not to include a geometrically defined throat. Thus, a choke is less likely to occur in the first blade row, so that the flow rate range can be further expanded.

(3) Simply excluding a geometrically defined throat from the first blade row may be insufficient for preventing a choke. Thus, in an aspect of the present disclosure, the margin constant M and the choke length c in inequality 1 are determined so as to satisfy inequality 2. In other words, the margin M, which is approximately 10% of the choke length c, is allowed for the distance S between each pair of adjacent first vanes to further prevent an occurrence of a choke in the first blade row. Thus, the flow rate range can be further expanded.

Obviously, numerous modifications and variations of the present invention are possible in light of the above teachings. It is therefore to be understood that within the scope of the appended claims, the invention may be practiced otherwise than as specifically described herein.

What is claimed is:

1. A compressor that compresses a fluid flowing through a fluid flow path, the compressor comprising:

an impeller rotatably disposed inside the fluid flow path, and an annular diffuser disposed around the impeller, the diffuser decelerating the fluid ejected from the impeller in a centrifugal direction, wherein the diffuser includes a first blade row, extending in a circumferential direction, and a second blade row, extending in the circumferential direction and located further in the centrifugal direction than is the first blade row, wherein the number of second vanes included in the second blade row is twice the number of first vanes included in the first blade row or larger, and wherein each first vane and an adjacent first vane do not define a throat therebetween, and wherein a choke length of each first vane, denoted with "c", an angle formed by each first vane and the centrifugal direction, denoted with "θ", and a distance between an inner end portion of each first vane in the centrifugal direction and an inner end portion of an adjacent first vane in the centrifugal direction, denoted with "S", satisfy $$c \leq S \cdot \sin\theta - M,$$

where "M" denotes a margin constant larger than zero.

2. The compressor according to claim 1, wherein the margin constant M and the choke length c satisfy $$M = c/10.$$

3. The compressor comprising a diffuser according to claim 1, wherein a distance from a center line of a rotational axis to a front end portion of each second vane, located on the inner side in the centrifugal direction, is equal to a distance from the center line of the rotational axis to a rear end portion of each first vane, located on the outer side in the centrifugal direction.

4. A compressor comprising:

a fluid flow path through which fluid is to flow;

an impeller provided in the fluid flow path and having a rotational axis around which the impeller is rotatable; and an annular diffuser provided around the rotational axis to surround the impeller in order to decelerate the fluid discharged from the impeller in a centrifugal direction with respect to the rotational axis, the annular diffuser comprising:

first vanes arranged in a first blade row extending in a circumferential direction around the rotational axis such that two adjacent vanes among the first vanes do not define a throat therebetween viewed along the rotational axis; and second vanes arranged in a second blade row which extends in the circumferential direction and which is provided farther than the first blade row in the centrifugal direction from the rotational axis, a number of the second vanes being two times or more as large as a number of first vanes, and wherein a choke length of each of the first vanes, denoted with "c", an angle formed by each of the first vanes and the centrifugal direction, denoted with "θ", and a distance between respective inner end portions of the two adjacent vanes among the first vanes in the centrifugal direction, denoted with "S", satisfy $$c \leq S \cdot \sin \theta - M,$$

where "M" denotes a margin constant larger than zero.

5. The compressor according to claim 4, wherein the margin constant M and the choke length c satisfy $$M = c/10.$$

6. The compressor according to claim 4, wherein a distance from a center line of the rotational axis to a front end portion of each second vane, located on the inner side in the centrifugal direction, is equal to a distance from the center line of the rotational axis to a rear end portion of each first vane, located on the outer side in the centrifugal direction.

* * * * *